US010153532B2

(12) United States Patent
Chou et al.

(10) Patent No.: US 10,153,532 B2
(45) Date of Patent: Dec. 11, 2018

(54) FILTER STRUCTURE IMPROVEMENT

(71) Applicant: Cirocomm Technology Corp., Tainan (TW)

(72) Inventors: Shin-Hui Chou, Tainan (TW); Chin-Hao Chen, Tainan (TW); Yue-Cheng Jhong, Tainan (TW); Yi-Ching Lin, Tainan (TW)

(73) Assignee: CIROCOMM TECHNOLOGY CORP., Tainan (TW)

( * ) Notice: Subject to any disclaimer, the term of this patent is extended or adjusted under 35 U.S.C. 154(b) by 139 days.

(21) Appl. No.: 15/384,320

(22) Filed: Dec. 20, 2016

(65) Prior Publication Data

US 2018/0175471 A1 Jun. 21, 2018

(51) Int. Cl.

| | |
|---|---|
| ***H01P 1/205*** | (2006.01) |
| ***H01P 1/20*** | (2006.01) |
| ***H01P 7/06*** | (2006.01) |

(52) U.S. Cl.

CPC ..... *H01P 1/2056* (2013.01); *H01P 1/2002* (2013.01); *H01P 1/205* (2013.01); *H01P 7/065* (2013.01)

(58) Field of Classification Search

CPC ..... H01P 1/2002; H01P 1/2056; H01P 7/065; H01P 1/205

USPC ..... 333/208, 209, 212

See application file for complete search history.

(56) References Cited

U.S. PATENT DOCUMENTS 6,597,263 B2 * 7/2003 Jun ..... H01P 1/2056 333/202

* cited by examiner

*Primary Examiner* — Rakesh Patel

(74) *Attorney, Agent, or Firm* — Chun-Ming Shih; HDLS IPR Services

(57) ABSTRACT

A filter structure improvement includes a substrate, resonance layers, a grounded layer, a pattern layer, an input electrode, and an output electrode. The substrate has resonance holes in which the resonance layers are disposed. One end of the resonance hole is on the open surface and the other end of the resonance hole is on the short-circuit surface. The grounded layer is on the short-circuit surface, top surface, bottom surface, and side surfaces and is electrically connected to the resonance layers to form a short-circuit end. The input and output electrodes, electrically isolated from the grounded layer, are on the bottom or open surface of the substrate. The pattern layer, resonance layers, and grounded layer are arranged to have electrical properties of a filter structure of mutual coupling such that a desired frequency band is obtained by adjusting the pattern layer and the lengths of the resonance layers.

14 Claims, 9 Drawing Sheets

FILTER STRUCTURE IMPROVEMENT

BACKGROUND OF THE INVENTION

Field of the Invention

The present invention relates to a filter and in particular to a filter structure improvement of surface mount technology which can change the frequency response.

Description of Prior Art

It is well known that surface mount filters are widely used in LNB (Low Noise Block), GPS (Global Positioning System) and Wi-Fi systems. When these filters are applied to these communication systems, their functions are to filter out the noise accompanying the single received by the communications to ensure the qualities of transmission and receiving of the communication systems.

The currently used filter comprises a substrate having plural resonance holes which penetrate through the substrate. One end of each of the resonance holes is disposed on an open surface; the other end of each of the resonance holes is disposed on a short-circuit surface. The short-circuit surface, the top surface, the bottom surface, and tow side surfaces of the substrate are all covered by an external conductive layer to form a ground surface of the filter. In addition, internal conductive layers are coated in the resonance holes to form resonators and are electrically connected to the external conductive layer to form a short-circuit end; the resonance holes on the open surface form an open end. Besides, an input pad and an output pad are formed on the bottom surface such that a gap is formed between the external conductive layer and each of the input pad and the output pad. After the filter is welded to a circuit board, the input pad and the output pad are used for signal input and signal output, respectively. Also, the external conductive layer on the bottom surface is electrically connected to the ground end of the circuit board.

The design pattern covered on the surface of the above-mentioned filter differs in various communication systems. If the pattern is not designed properly on the filter surface, the characteristics of the filter will be affected.

SUMMARY OF THE INVENTION

Therefore, a main objective of the present invention is to improve the characteristics of the filter structure and thus the metal pattern layer is disposed on the open surface in the present invention to increase the whole coupling capacitance of the filter structure to obtain the desired operating frequency band. In addition, the present invention has the effects of low insertion loss and out-band rejection.

Another objective of the present invention is to provide a filter structure having a single resonance hole which comprises at least two holes of different shapes, which can reduce the size of the filter to increase the Q value of the filter structure and to mitigate the spurious response.

Yet another objective of the present invention is to provide a filter structure having a single resonance hole which comprises at least two holes of different lengths, which can modify the performance of the filter structure and improve the frequency response of the filter structure.

To achieve the above objectives, the present invention provides a filter structure improvement which comprises a substrate, a plurality of resonance metal layers, a grounded metal layer, a metal pattern layer, an input electrode, and an output electrode. The substrate has an open surface, a short-circuit surface, a top surface, a bottom surface, and two side surfaces disposed thereon. The substrate has a plurality of resonance holes penetrating through the substrate. One end of each of the resonance holes is disposed on the open surface and the other end of each of the resonance holes is disposed on the short-circuit surface. The resonance metal layers are disposed in the resonance holes. The grounded metal layer is disposed on the short-circuit surface, the top surface, the bottom surface, and the two side surfaces. The grounded metal layer on the short-circuit surface is electrically connected to the resonance metal layers in the resonance holes to form a short-circuit end. The resonance metal layers on the open surface form an open end. The grounded metal layer disposed on the bottom surface has an E-shaped pattern; two sides of the grounded metal layer of the E-shaped pattern are provided with two bare regions which expose the substrate and extend on the open surface. The metal pattern layer is disposed on the open surface and electrically connected to the grounded metal layer. The input electrode is disposed on one of the two bare regions; the output electrode is disposed on the other one of the two bare regions. The metal pattern layer, the resonance metal layers, and the grounded metal layer are arranged to have electrical properties of a filter structure of mutual coupling such that a desired frequency band is obtained by adjusting the metal pattern layer and the lengths of the resonance metal layers.

In an embodiment of the present invention, the metal pattern layer comprises a plurality of lines which include a first edge line, a second edge line, a first straight line, a second straight line, and a third straight line.

In an embodiment of the present invention, the first edge line is disposed on the intersection of the open surface and the top surface, the intersections of the two side surfaces and the open surface, and the intersection of the open surface and the bottom surface, and is electrically connected to the grounded metal layer. The second edge line is disposed on the intersection of the open surface and the bottom surface, and is electrically connected to the grounded metal layer.

In an embodiment of the present invention, the first straight line is disposed between two adjacent resonance holes and is electrically connected to the first edge line and the second edge line. Also, the second straight line is disposed between two adjacent resonance holes and is electrically connected to the first edge line and the second edge line. The second straight line is a dashed line with a separation. The third straight line is disposed between two adjacent resonance holes and is electrically connected to the first edge line and the second edge line. The third straight line is a dashed line with a separation which is adjacent to the first edge line.

In an embodiment of the present invention, one end of the input electrode is disposed on one of the two bare regions; the other end of the input electrode extends on the open surface and is adjacent to one of the resonance holes.

In an embodiment of the present invention, one end of the output electrode is disposed on the other one of the two bare regions; the other end of the output electrode extends on a bare region of the open surface and is adjacent to one of the resonance holes.

In an embodiment of the present invention, the metal pattern layer comprises a plurality of rectangular blocks and a line section. The rectangular blocks are individually disposed around the resonance holes on the open surface and are electrically connected to the resonance metal layers disposed in the resonance holes. A gap is formed between each two adjacent rectangular blocks. The line section is disposed on a common side of the rectangular blocks.

In an embodiment of the present invention, one end of the input electrode and one end of the output electrode are individually on the two bare regions of the bottom surface of the substrate. The other end of the input electrode and the other end of the output electrode extend on the open surface to have a respective L-like shape and are adjacent to another side of the first rectangular block and another side of the fourth rectangular blocks, respectively, to form a respective gap.

In an embodiment of the present invention, the resonance holes are circular holes, elliptical holes of different opening sizes, or elliptical holes having circular holes therein.

In an embodiment of the present invention, the resonance metal layers are disposed on the inner walls of the elliptical holes and the circular holes.

In an embodiment of the present invention, the lengths of the elliptical holes are less than those of the circular holes.

In an embodiment of the present invention, the metal pattern layer has an inversed E-like shape. The grounded metal layer of the inversed E-like shape is disposed on a common side of the resonance holes and is electrically connected to the grounded metal layer on the top surface and the two side surfaces. The inversed E-like shape has a ring portion surrounding the elliptical hole with the smallest diameter. The ring portion is electrically connected to the grounded metal layer on the bottom surface.

To achieve the above objectives, the present invention provides another filter structure improvement which comprises a substrate, a plurality of resonance metal layers, a grounded metal layer, a metal pattern layer, an input electrode, and an output electrode. The substrate has an open surface, a short-circuit surface, a top surface, a bottom surface, and two side surfaces disposed thereon. The substrate has a plurality of resonance holes penetrating through the substrate. One end of each of the resonance holes is disposed on the open surface and the other end of each of the resonance holes is disposed on the short-circuit surface. The resonance metal layers are disposed in the resonance holes. The grounded metal layer is disposed on the short-circuit surface, the top surface, the bottom surface, and the two side surfaces. The grounded metal layer on the short-circuit surface is electrically connected to the resonance metal layers in the resonance holes to form a short-circuit end; the resonance metal layers on the open surface form an open end. Besides, the grounded metal layer disposed on the bottom surface has an E-shaped pattern; two sides of the grounded metal layer of the E-shaped pattern are provided with two bare regions which expose the substrate and extend on the open surface. The metal pattern layer is disposed on the open surface. The input electrode is disposed on one of the two bare regions; the output electrode is disposed on the other one of the two bare regions. The metal pattern layer, the resonance metal layers, and the grounded metal layer are arranged to have electrical characteristics of a filter structure of mutual coupling such that a desired frequency band is obtained by adjusting the metal pattern layer and the lengths of the resonance metal layers.

In an embodiment of the present invention, the resonance holes are circular holes, elliptical holes of different opening sizes, or elliptical holes having circular holes therein.

In an embodiment of the present invention, the resonance metal layers are disposed on the inner walls of the elliptical holes and the circular holes.

In an embodiment of the present invention, the lengths of the elliptical holes are less than those of the circular holes.

In an embodiment of the present invention, the metal pattern layer is a line section disposed on a common side of the resonance holes.

DETAILED DESCRIPTION OF THE INVENTION

The detailed description and technical details of the present invention will be explained below with reference to accompanying drawings.

Figure 1:
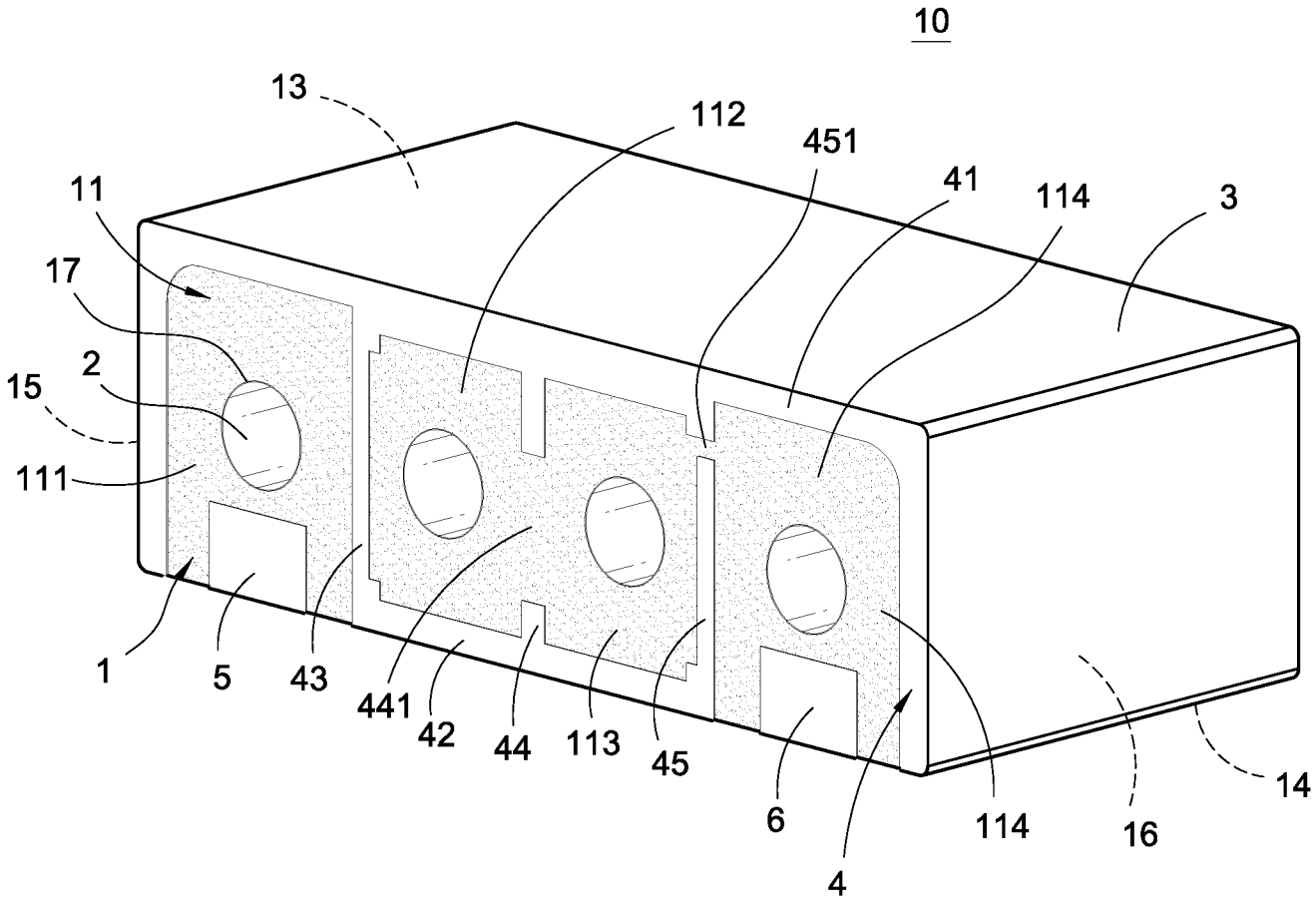
FIG. 1 shows a perspective schematic view of the filter structure improvement according to the first embodiment of the present invention.
Figure 2:
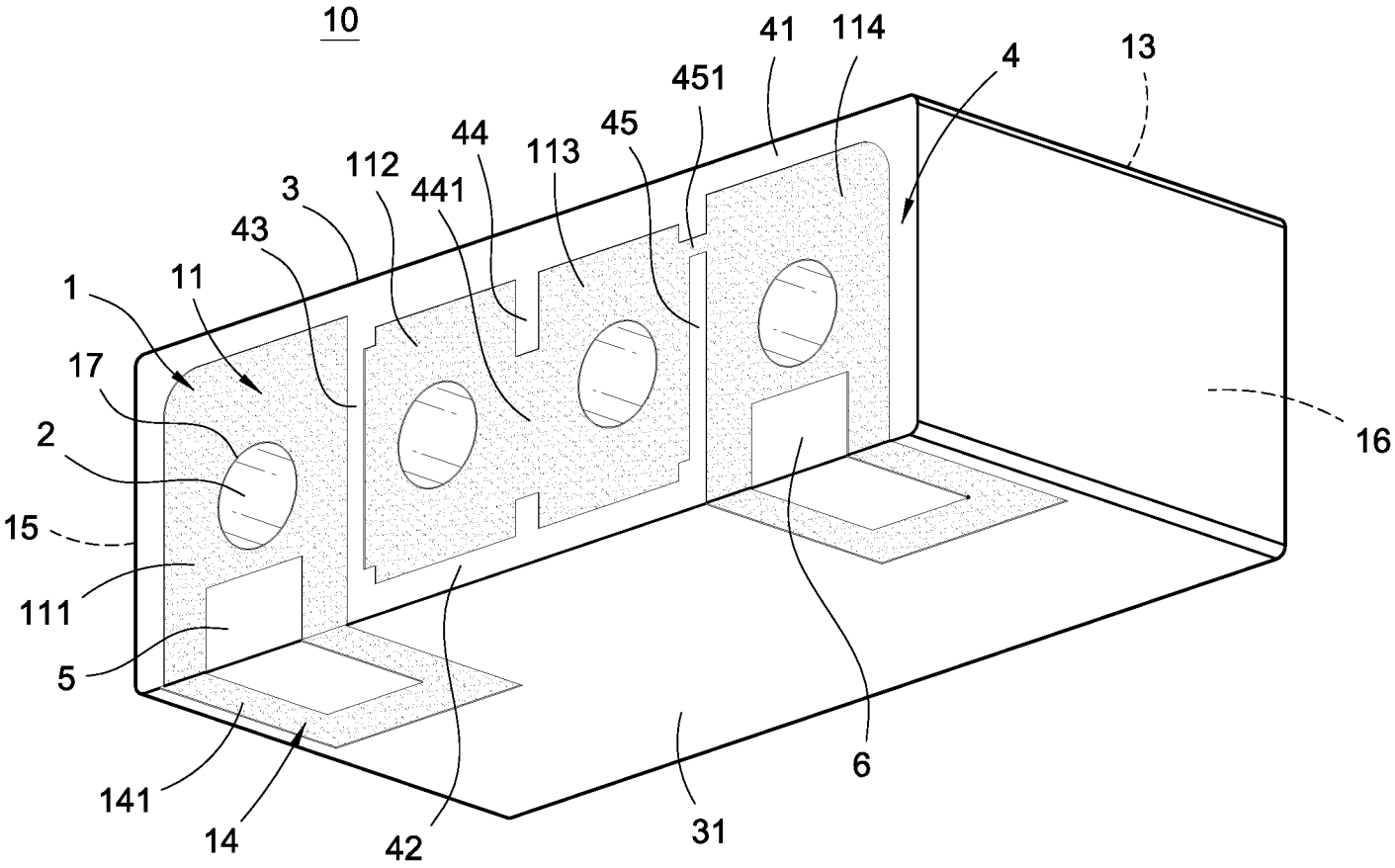
FIG. 2 shows a bottom view of FIG. 1.
Figure 3:
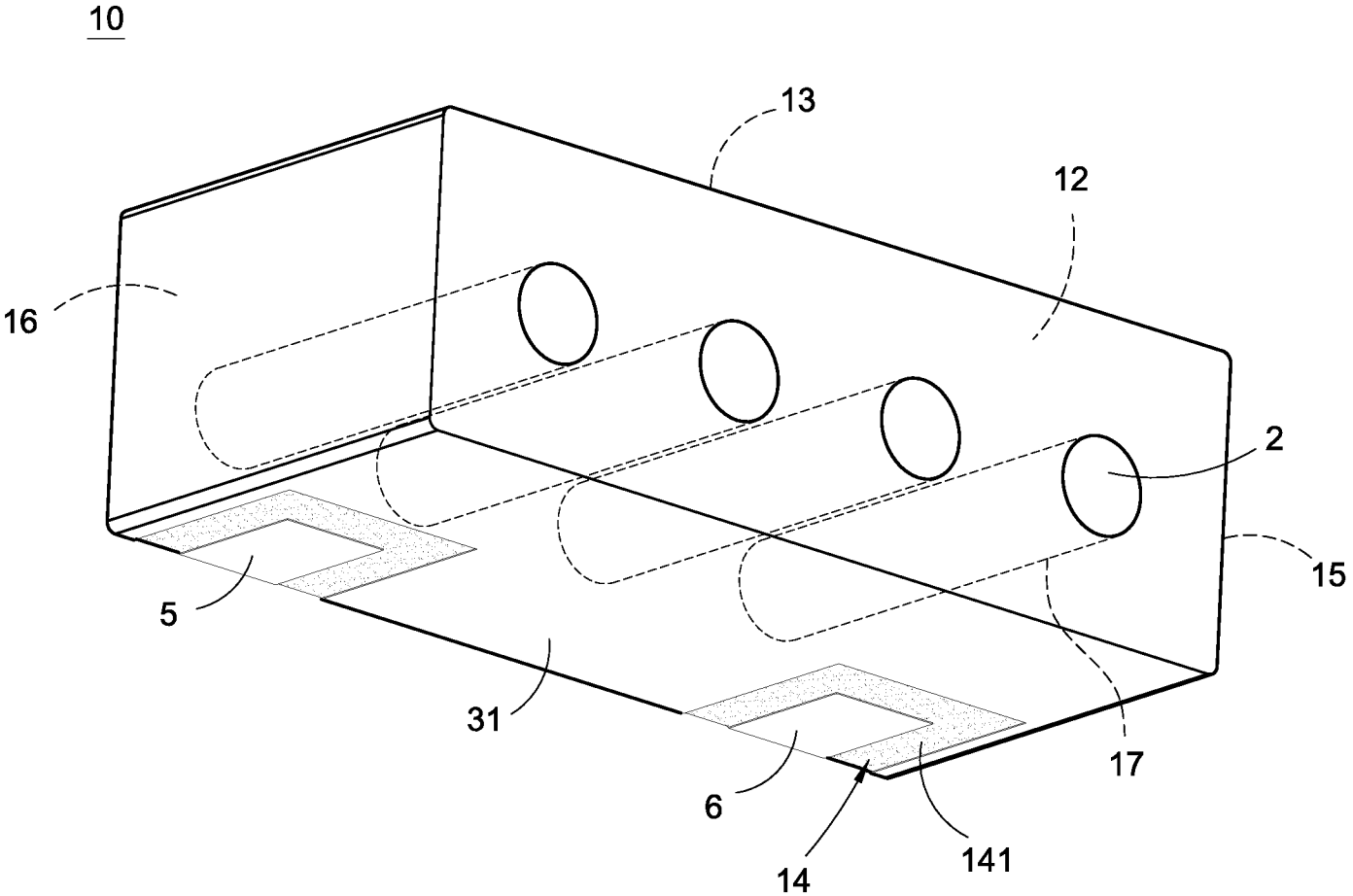
FIG. 3 shows a rear view of FIG. 1.

Please refer to FIGS. 1-3, which are the perspective schematic view, the bottom view, and the rear view of the filter structure improvement according to the first embodiment of the present invention, respectively. As shown in the above figures, the filter structure 10 comprises a substrate 1, a plurality of resonance metal layers 2, a grounded metal layer 3, a metal pattern layer 4, an input electrode 5, and an output electrode 6. The internal metal layer 2, the grounded metal layer 3, the input electrode 5, and the output electrode 6 cover the substrate 1 to form a dielectric filter structure. The substrate 1 is a cuboid made of ceramic material with high dielectric coefficient and has an open surface 11, a short-circuit surface 12, a top surface 13, a bottom surface 14, and two side surfaces 15, 16 disposed thereon. The substrate 1 has a plurality of resonance holes 17 penetrating through the substrate 1. One end of each of the resonance holes 17 is disposed on the open surface 11 and the other end of each of the resonance holes 17 is disposed on the short-circuit surface 12. In the current figures, the resonance holes are circular holes.

The resonance metal layers 2 are disposed on the inner walls of the resonance holes 17 such that the resonance holes 17 form the resonators of the filter structure 10.

The grounded metal layer 3 are disposed on the short-circuit surface 12, the top surface 13, the bottom surface 14, and the two side surfaces 15, 16 in which the grounded metal layer 3 on the short-circuit surface 12 is electrically connected to the resonance metal layers 2 in the resonance holes 17 to form a short-circuit end and the resonance metal layers 2 on the open surface 11 form an open end. Besides, the grounded metal layer 3 disposed on the bottom surface 14 has an E-shaped pattern 31; two sides of the E-shaped pattern 31 are provided with two bare regions 141 which expose the substrate 1 and extend on the open surface 11.

The metal pattern layer 4 comprises a plurality of lines which include a first edge line 41, a second edge line 42, a first straight line 43, a second straight line 44, and a third straight line 45. The first edge line 41 is disposed on the intersection of the open surface 11 and the top surface 13, the intersections of the two side surfaces 15, 16 and the open surface 11, and the intersection of the open surface 11 and the bottom surface 14, and is electrically connected to the grounded metal layer 3. The second edge line 42 is disposed on the intersection of the open surface 11 and the bottom surface 14, and is electrically connected to the grounded metal layer 3. In addition, the first straight line 43 is disposed between two adjacent resonance holes 17 and is electrically connected to the first edge line 41 and the second edge line 42. The second straight line 44 is disposed between two adjacent resonance holes 17 and is electrically connected to the first edge line 41 and the second edge line 42 in which the second straight line 44 is a dashed line with a separation 441. The third straight line 45 is disposed between two adjacent resonance holes 17 and is electrically connected to the first edge line 41 and the second edge line 42 in which the third straight line 45 is a dashed line with a separation 451 which is adjacent to the first edge line 41. The first edge line 41, the second edge line 42, the first straight line 43, the second straight line 44, and the third straight line 45 of the metal pattern layer 4 are arranged to form the bare regions 111, 112, 113, 114 on the open surface 11. The above-mentioned metal pattern layer 4, the resonance metal layers 2 of the resonance holes 17, and the grounded metal layer 3 are arranged to have electrical properties of a filter structure 10 of mutual coupling such that a desired frequency bandwidth can be obtained by adjusting the metal pattern layer 4 and the lengths of the resonance metal layers 2, and the effects of low insertion loss and out-band rejection can be achieved.

As for the input electrode 5, one end thereof is disposed on the bare region 141; the other end thereof extends on the bare region 111 of the open surface 11 and is adjacent to one of the resonance holes 17. The input electrode 5 is used to input the signal into the filter structure 10 for the filtering process.

As for the output electrode 6, one end thereof is disposed on the bare region 141; the other end thereof extends on the bare region 114 of the open surface 11 and is adjacent to one of the resonance holes 17. The output electrode 6 is used to output the single after the filtering process of the filter structure 10.

By means of the input electrode 5 and the output electrode 6 of the filter structure 10, and the grounded metal layer 3 of the bottom surface 14, the filter structure 10 can be adhered to a circuit board (not shown) by surface mounting.

Figure 4:
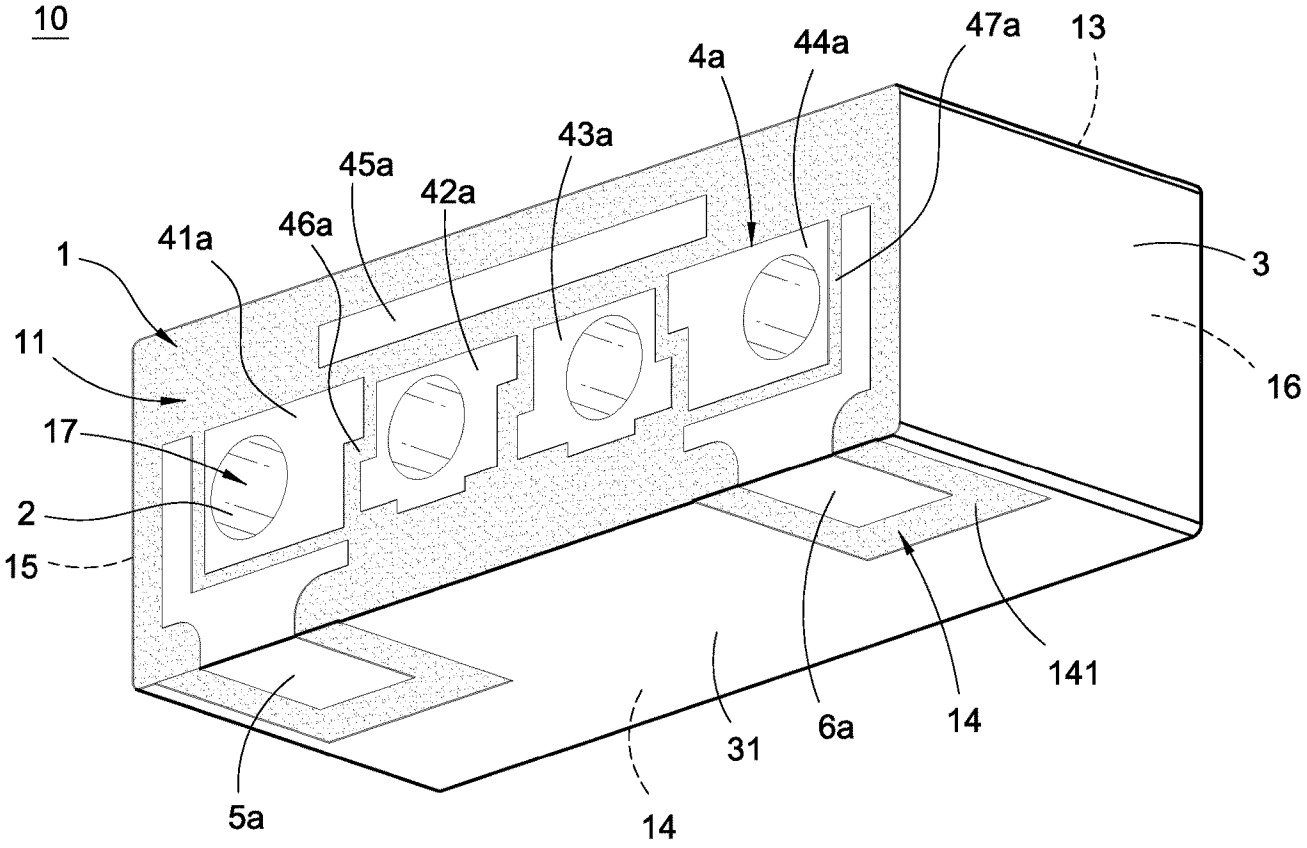
FIG. 4 shows a perspective schematic view of the filter structure improvement according to the second embodiment of the present invention.

Please refer to FIG. 4, which shows a perspective schematic view of the filter structure improvement according to the second embodiment of the present invention. As shown in FIG. 4, the filter structure 10 disclosed according to the second embodiment is roughly similar to that disclosed according to the first embodiment. The differences between the first and second embodiment are the metal pattern layer 4*a*, the input electrode 5*a*, and the output electrode 6*a*. The metal pattern layer 4*a* comprises a plurality of rectangular blocks 41*a*, 42*a*, 43*a*, 44*a* and a line section 45*a*. The rectangular blocks 41*a*, 42*a*, 43*a*, 44*a* are individually disposed around the resonance holes 17 and are electrically connected to the resonance metal layers 2 in the resonance holes 17. A gap 46 is formed between each two adjacent rectangular blocks 41*a*, 42*a*, 43*a*, 44*a*. The line section 45*a* is disposed on a common side of the rectangular blocks 41*a*, 42*a*, 43*a*, 44*a*.

One end of the input electrode 5*a* and one end of the output electrode 6*a* are individually disposed on the bare regions 141 of the bottom surface 14 of the substrate 1. The other end of the input electrode 5*a* and the other end of the output electrode 6*a* extend on the open surface 11 to have a respective L-like shape and are adjacent to another side of the first rectangular block 41*a* and another side of the fourth rectangular blocks 44*a*, respectively, to form a respective gap 47*a*.

Similarly, by means of the arrangement of the metal pattern layer 4*a*, the input electrode 5*a*, the output electrode 6*a* of the filter structure 10, the resonance metal layers 2 of the resonance holes 17, and the grounded metal layer 3, the electrical properties of a filter structure 10 of mutual coupling can be obtained. Thus, a desired frequency band can be obtained by adjusting the metal pattern layer 4 and the lengths of the resonance metal layers 2, and the effects of low insertion loss and out-band rejection can be achieved.

Figure 5A:
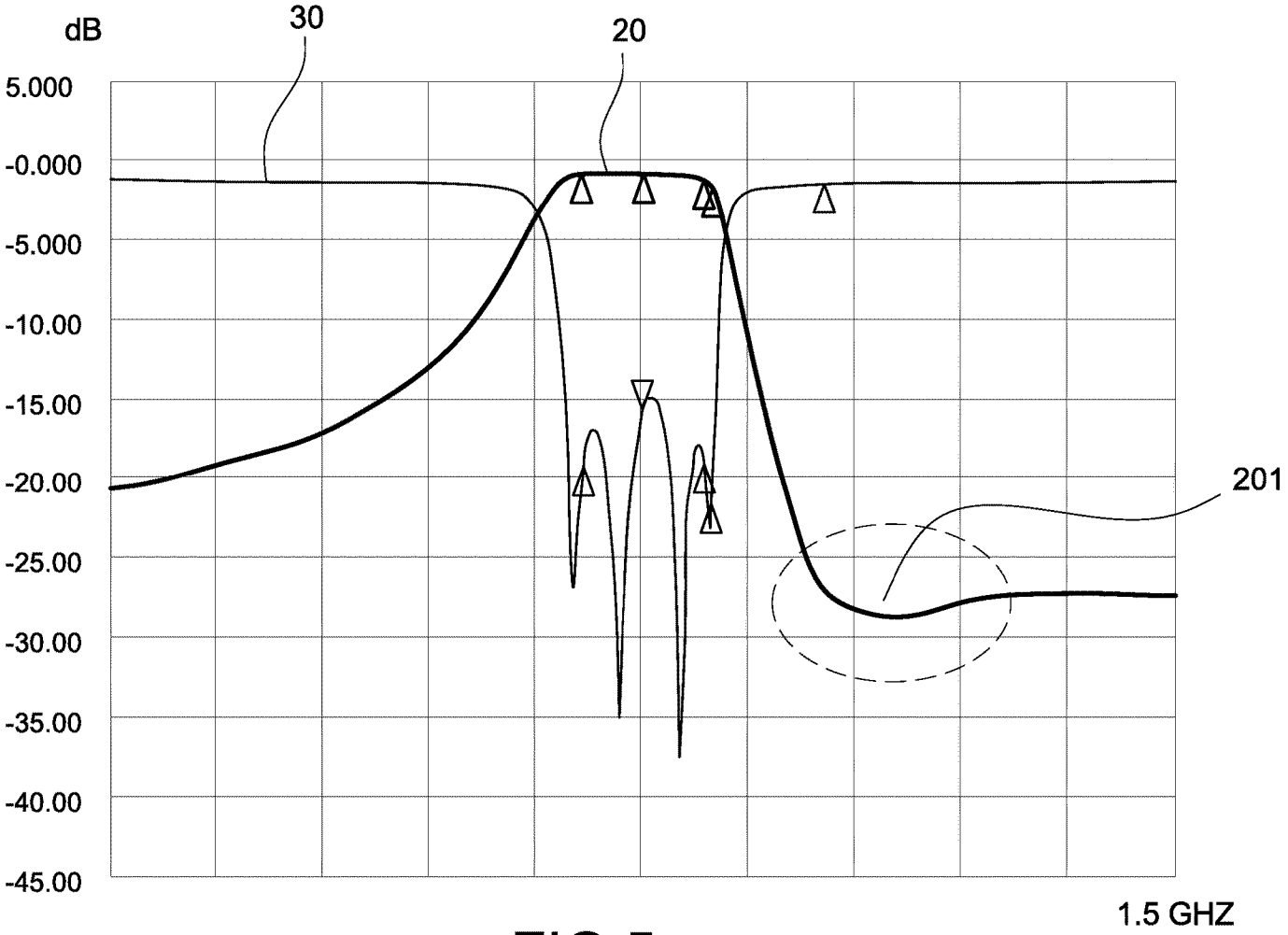
FIG. 5*a* shows a schematic view of the measurement curves of the input reflection coefficient (S11) and the forward reflection coefficient (S21) of the filter structure improvement according to the first embodiment of the present invention.
Figure 5B:
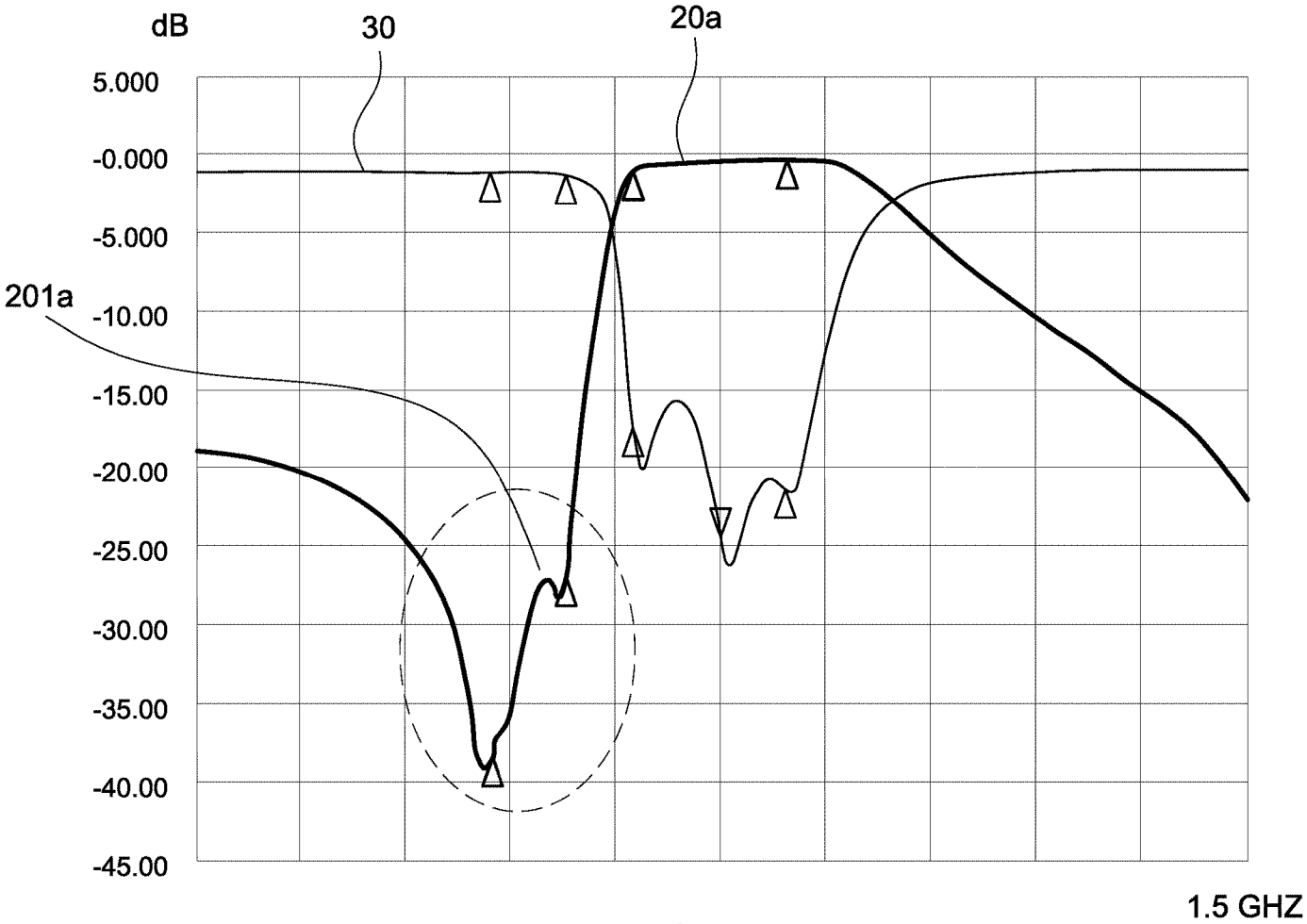
FIG. 5*b* shows a schematic view of the measurement curves of the input reflection coefficient (S11) and the forward transmission coefficient (S21) of the filter structure improvement according to the second embodiment of the present invention.

Please refer to FIGS. 5*a* and 5*b*, which are the schematic views of the measurement curves of the input reflection coefficient (S11) and the forward transmission coefficient (S21) of the filter structure improvement according to the first embodiment of the present invention and according to the second embodiment of the present invention, respectively. As shown in the above figures, because the design patterns of the metal pattern layer 4 and the metal pattern layer 4*a* of the filter structures 10 in the first and second embodiments are different from each other, the measurements indicate the reflection coefficient (S11) cures 20, 20*a* and the measured forward transmission coefficient (S21) curves 30, 30*a*. Thus, the location of the stopband transmission zero 201 is shown on the right side of the curve 20 after the measurement of the forward transmission coefficient of the filter structure 10 in the first embodiment; however, the location of the stopband transmission zero 201*a* is shown on the left side of the curve 20*a* after the measurement of the forward transmission coefficient of the filter structure 10 in the second embodiment.

From the above measurement results, the different pattern designs between the metal pattern layer 4 and the metal pattern layer 4*a* of the filter structures 10 in the first and second embodiments can provide different operating frequency bands and cause the different locations of the stopband transmission zero of the filter structure 10.

Figure 6:
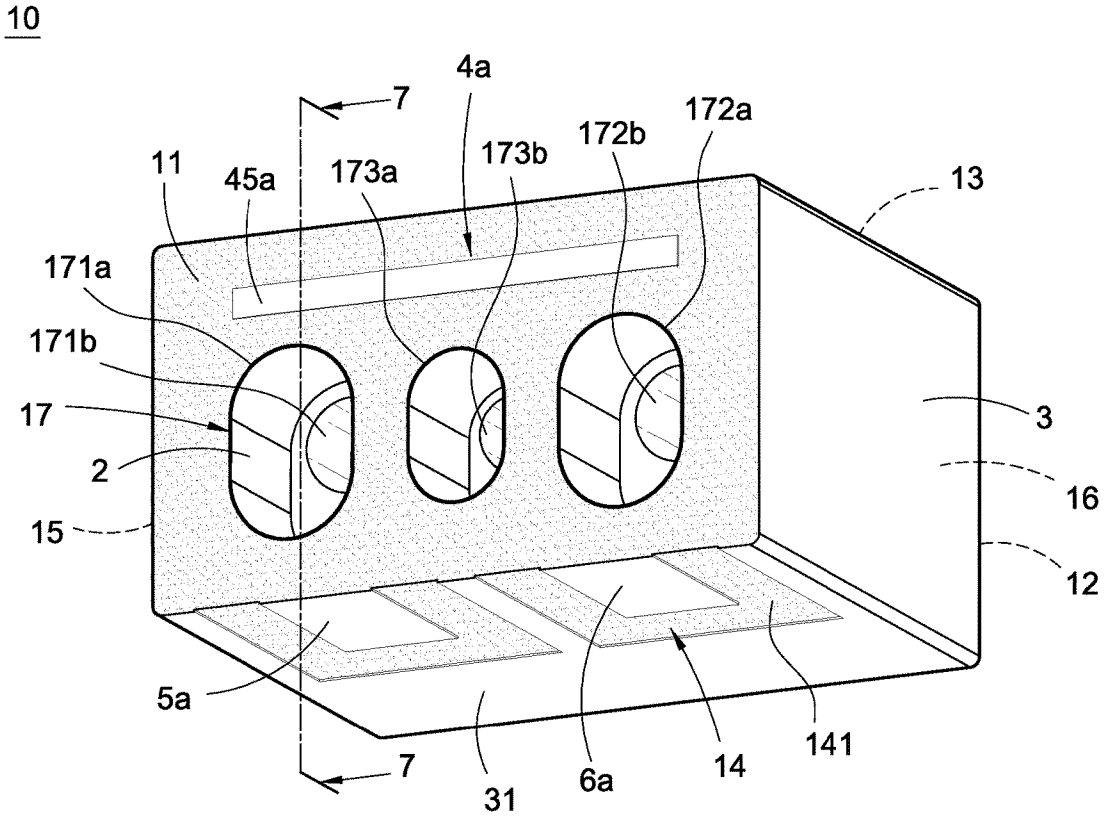
FIG. 6 shows a perspective schematic view of the filter structure improvement according to the third embodiment of the present invention.
Figure 7:
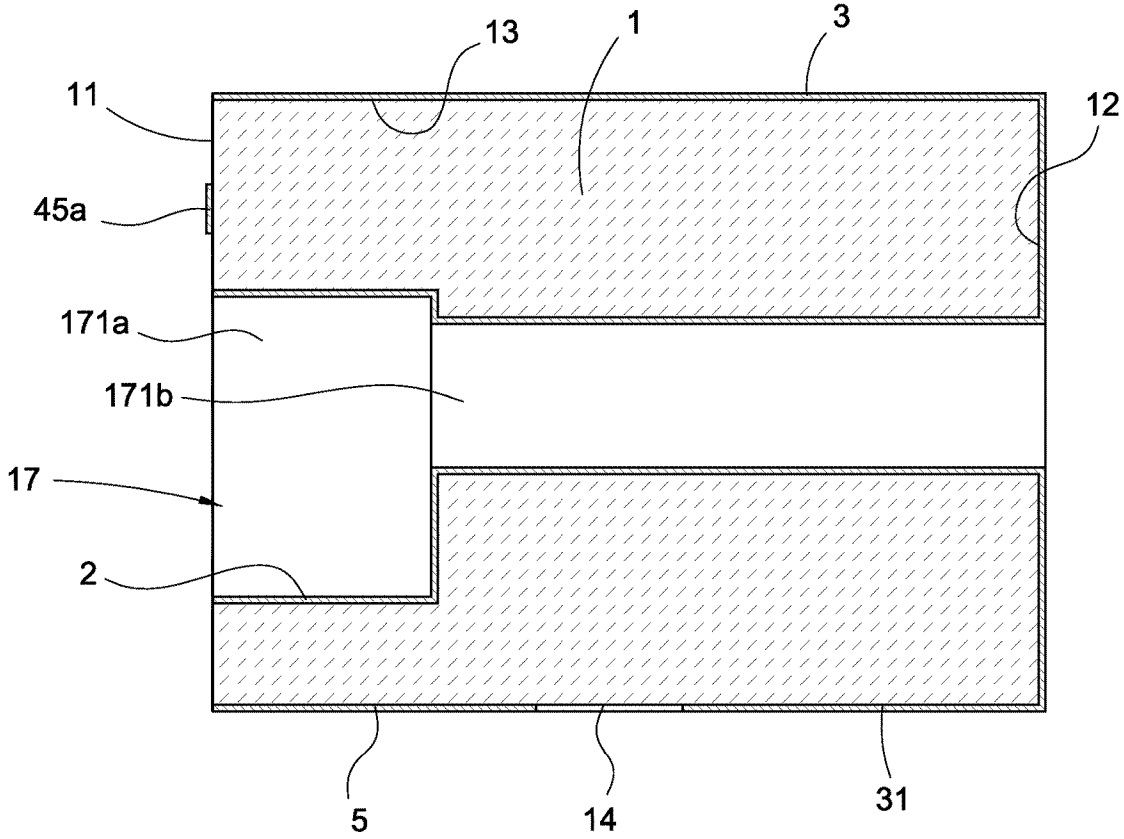
FIG. 7 shows a cross-sectional view along line 7-7 of FIG. 6.

Please refer to FIGS. 6 and 7, which are the perspective schematic view of the filter structure improvement according to the third embodiment of the present invention and the cross-sectional view along line 7-7 of FIG. 6, respectively. As shown in FIGS. 6 and 7, the current embodiment is roughly similar to the first embodiment. The difference is that the resonance holes 17 are elliptical holes of different opening sizes 171*a*, 172*a*, and 173*a*. In the current embodiment, the elliptical hole of small opening size 173*a* is disposed between two elliptical holes of large opening size 171*a*, 172*a*. The circular holes 171*b*, 172*b*, and 173*b* are disposed inside the elliptical holes 171*a*, 172*a*, and 173*a*, respectively, and are close to the upper edges of the inner walls of the elliptical holes 171*a*, 172*a*, and 173*a*, respectively. Besides, the resonance metal layers 2 are disposed on the inner walls of the elliptical holes 171*a*, 172*a*, 173*a* and the circular holes 171*b*, 172*b*, and 173*b*. The design purpose of the resonance holes 17 using the elliptical hole 171*a* (172*a*, 173*a*) communicating with the circular hole 171*b* (172*b*, 173*b*) is mainly to reduce the size of the filter structure 10 to increase the Q value of the filter structure and to mitigate the spurious response. In the current figures, the length of the elliptical hole 171*a* (172*a*, 173*a*) is less than that of the circular hole 171*b* (172*b*, 173*b*). The lengths of the elliptical holes 171*a*, 172*a*, and 173*a* can be used to modify the performance of the filter structure 10 and improve the frequency response of the filter structure 10.

Moreover, the input electrode 5 and the output electrode 6 are disposed only on the bare region 141 of the bottom surface 14; the other ends of the input electrode 5 and the output electrode 6 do not extend on the open surface 11.

It is worth mentioning that the line section 45*a* of the metal pattern layer 4*a* in the second embodiment can be disposed on a common side of the resonance holes 17 such that the line section 45*a* and the resonance metal layers 2 in the resonance holes 17 can form coupling capacitance and inductance. As a result, the filter structure 10 can improve the reflection coefficient (S11) matching and the out-band rejection level to obtain the desired operating frequency band.

Figure 8:
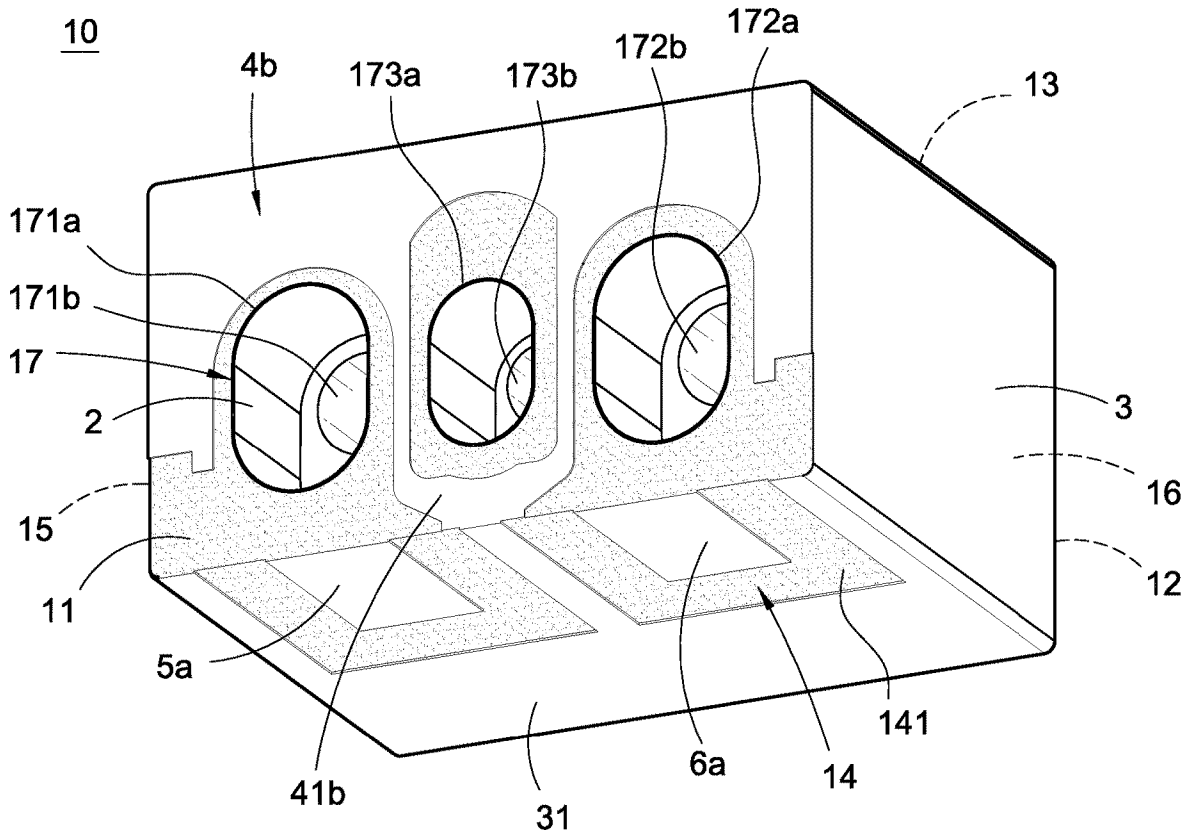
FIG. 8 shows a perspective schematic view of the filter structure improvement according to the fourth embodiment of the present invention.

Please refer to FIG. 8, which is a perspective schematic view of the filter structure improvement according to the fourth embodiment of the present invention. As shown in FIG. 8, the current embodiment is roughly similar to the third embodiment. The difference is that the metal pattern layer 4*b* has an inversed E-like shape in the fourth embodiment. The grounded metal layer 3 of the inversed E-like shape is disposed on a common side of the resonance holes 17 and is electrically connected to the grounded metal layer 3 on the top surface 13 and the two side surfaces 15, 16. The inversed E-like shape has a ring portion 41*b* surrounding the elliptical hole 173*a* with the smallest diameter. The ring portion 41*b* is electrically connected to the grounded metal layer 3 on the bottom surface 14.

By means of the arrangement of the design of the metal pattern layer 4*b* having the inversed E-like shape and the resonance metal layers 2 of the resonance holes 17, the electrical properties of a filter structure 10 of mutual coupling can be obtained. Thus, a desired frequency band can be obtained by adjusting the metal pattern layer 4*b* and the lengths of the resonance metal layers 2.

In summary, the embodiments disclosed in the description are only preferred embodiments of the present invention, but not to limit the scope of the present invention. The scope of the present invention should be embraced by the accompanying claims and includes all the equivalent modifications and not be limited to the previous description.

What is claimed is:

1. A filter structure improvement, comprising:

a substrate having an open surface, a short-circuit surface, a top surface, a bottom surface, and two side surfaces disposed thereon, wherein the substrate has a plurality of resonance holes penetrating through the substrate, wherein one end of each of the plurality of resonance holes is disposed on the open surface and the other end of each of the plurality of resonance holes is disposed on the short-circuit surface;

a plurality of resonance metal layers disposed in the plurality of resonance holes;

a grounded metal layer disposed on the short-circuit surface, the top surface, the bottom surface, and the two side surfaces, wherein the grounded metal layer on the short-circuit surface is electrically connected to the plurality of resonance metal layers in the plurality of resonance holes to form a short-circuit end and the plurality of resonance metal layers on the open surface form an open end, wherein the grounded metal layer disposed on the bottom surface has an E-shaped pattern, wherein two sides of the grounded metal layer of the E-shaped pattern are provided with two bare regions which expose the substrate and extend on the open surface;

a metal pattern layer disposed on the open surface and electrically connected to the grounded metal layer;

an input electrode disposed on one of the two bare regions; and an output electrode disposed on the other one of the two bare regions, wherein the metal pattern layer, the plurality of resonance metal layers, and the grounded metal layer are arranged to have electrical properties of a filter structure of mutual coupling such that a desired frequency band is obtained by adjusting the metal pattern layer and lengths of the plurality of resonance metal layers;

wherein the metal pattern layer comprises a plurality of lines which include a first edge line, a second edge line, a first straight line, a second straight line, and a third straight line.

2. The filter structure improvement according to claim 1, wherein the first edge line is disposed on an intersection of the open surface and the top surface, intersections of the two side surfaces and the open surface, and intersection of the open surface and the bottom surface, and is electrically connected to the grounded metal layer, wherein the second edge line is disposed on the intersection of the open surface and the bottom surface, and is electrically connected to the grounded metal layer.

3. The filter structure improvement according to claim 2, wherein the first straight line is disposed between two adjacent resonance holes and is electrically connected to the first edge line and the second edge line, wherein the second straight line is disposed between two adjacent resonance holes and is electrically connected to the first edge line and the second edge line, wherein the second straight line is a dashed line with a separation, wherein the third straight line is disposed between two adjacent resonance holes and is electrically connected to the first edge line and the second edge line, wherein the third straight line is a dashed line with a separation which is adjacent to the first edge line.

4. The filter structure improvement according to claim 3, wherein one end of the input electrode is disposed on one of the two bare regions, wherein the other end of the input electrode extends on the open surface and is adjacent to one of the resonance holes.

5. The filter structure improvement according to claim 4, wherein one end of the output electrode is disposed on the other one of the two bare regions, wherein the other end of the output electrode extends on a bare region of the open surface and is adjacent to one of the resonance holes.

6. The filter structure improvement according to claim 1, wherein the resonance holes are circular holes, elliptical holes of different opening sizes, or elliptical holes having circular holes therein.

7. The filter structure improvement according to claim 6, wherein the resonance metal layers are disposed on inner walls of the elliptical holes and the circular holes.

8. The filter structure improvement according to claim 7, wherein the lengths of the elliptical holes are less than those of the circular holes.

9. The filter structure improvement according to claim 8, wherein the metal pattern layer has an inversed E-like shape and is disposed on a common side of the resonance holes and is electrically connected to the grounded metal layer on the top surface and the two side surfaces, wherein the inversed E-like shape has a ring portion surrounding the elliptical hole with the smallest diameter, wherein the ring portion is electrically connected to the grounded metal layer on the bottom surface.

10. A filter structure improvement, comprising:

a substrate having an open surface, a short-circuit surface, a top surface, a bottom surface, and two side surfaces disposed thereon, wherein the substrate has a plurality of resonance holes penetrating through the substrate, wherein one end of each of the plurality of resonance holes is disposed on the open surface and the other end of each of the plurality of resonance holes is disposed on the short-circuit surface;

a plurality of resonance metal layers disposed in the plurality of resonance holes;

a grounded metal layer disposed on the short-circuit surface, the top surface, the bottom surface, and the two side surfaces, wherein the grounded metal layer on the short-circuit surface is electrically connected to the plurality of resonance metal layers in the plurality of resonance holes to form a short-circuit end and the plurality of resonance metal layers on the open surface form an open end, wherein the grounded metal layer disposed on the bottom surface has an E-shaped pattern, wherein two sides of the grounded metal layer of the E-shaped pattern are provided with two bare regions which expose the substrate and extend on the open surface;

a metal pattern layer disposed on the open surface and electrically connected to the grounded metal layer;

an input electrode disposed on one of the two bare regions; and an output electrode disposed on the other one of the two bare regions, wherein the metal pattern layer, the plurality of resonance metal layers, and the grounded metal layer are arranged to have electrical properties of a filter structure of mutual coupling such that a desired frequency band is obtained by adjusting the metal pattern layer and lengths of the plurality of resonance metal layers;

wherein the metal pattern layer comprises a plurality of rectangular blocks and a line section, wherein the rectangular blocks are individually disposed around the plurality of resonance holes on the open surface and are electrically connected to the plurality of resonance metal layers disposed in the plurality of resonance holes, wherein a gap is formed between each two adjacent rectangular blocks, wherein the line section is disposed on a common side of the rectangular blocks.

11. The filter structure improvement according to claim 10, wherein one end of the input electrode and one end of the output electrode are individually disposed on the two bare regions of the bottom surface of the substrate, wherein the other end of the input electrode and the other end of the output electrode extend on the open surface to have a respective L-like shape and are adjacent to another side of a first one of the plurality of rectangular blocks and another side of a fourth one of the plurality of rectangular blocks, respectively, to form a respective gap.

12. A filter structure improvement, comprising:

a substrate having an open surface, a short-circuit surface, a top surface, a bottom surface, and two side surfaces disposed thereon, wherein the substrate has a plurality of resonance holes penetrating through the substrate, wherein one end of each of the plurality of resonance holes is disposed on the open surface and the other end of each of the plurality of resonance holes is disposed on the short-circuit surface;

a plurality of resonance metal layers disposed in the plurality of resonance holes;

a grounded metal layer disposed on the short-circuit surface, the top surface, the bottom surface, and the two side surfaces, wherein the grounded metal layer on the short-circuit surface s electrically connected to the plurality of resonance metal layers in the plurality of resonance holes to form a short-circuit end and the plurality of resonance metal layers on the open surface form an open end, wherein the grounded metal layer disposed on the bottom surface has an E-shaped pattern, wherein two sides of the grounded metal layer of the E-shaped pattern are provided with two bare regions which expose the substrate and extend on the open surface;

a metal pattern layer disposed on the open surface;

an input electrode disposed on one of the two bare regions; and an output electrode disposed on the other one of the two bare regions, wherein the metal pattern layer, the plurality of resonance metal layers, and the grounded metal layer are arranged to have electrical characteristics of a filter structure of mutual coupling such that a desired frequency band is obtained by adjusting the metal pattern layer and the lengths of the plurality of resonance metal layers;

wherein the plurality of resonance holes are circular holes, elliptical holes of different opening sizes, or elliptical holes having circular holes therein;

wherein the plurality of resonance metal layers are disposed on inner walls of the elliptical holes and the circular holes.

13. The filter structure improvement according to claim 12, wherein the lengths of the elliptical holes are less than those of the circular holes.

14. The filter structure improvement according to claim 13, wherein the metal pattern layer is a line section disposed on a common side of the resonance holes.

* * * * *